US006115864A

United States Patent [19]

Davidsson et al.

[11] Patent Number: 6,115,864

[45] Date of Patent: Sep. 12, 2000

[54] APPARATUS FOR CLEANING A WATER-FILLED POOL

[75] Inventors: Marcus Davidsson, Sundbyberg; Anders Ekenbäck, Södertälje; Klas Lange, Djursholm, all of Sweden

[73] Assignee: Weda Poolcleaner AB, Södertälje, Sweden

[21] Appl. No.: 09/160,244

[22] Filed: Sep. 25, 1998

[30] Foreign Application Priority Data

Sep. 26, 1997 [SE] Sweden ..... 9703476

[51] Int. Cl.[7] ..... E04H 4/16

[52] U.S. Cl. ..... 15/1.7

[58] Field of Search ..... 15/1.7; 210/169, 210/416.2

[56] References Cited

U.S. PATENT DOCUMENTS

| | | | |
|---|---|---|---|
| 2,988,762 | 6/1961 | Babcock . | |
| 3,950,809 | 4/1976 | Schatzmann | 15/1.7 |
| 4,154,680 | 5/1979 | Sommer | 15/1.7 |
| 5,337,434 | 8/1994 | Erlich . | |
| 5,351,355 | 10/1994 | Chiniara | 15/1.7 |

FOREIGN PATENT DOCUMENTS

| | | |
|---|---|---|
| 1920172 | 10/1970 | Germany . |
| 436777 | 1/1985 | Sweden . |
| 465629 | 10/1991 | Sweden . |
| WO 94/23159 | 10/1994 | WIPO . |

*Primary Examiner*—Terrence R. Till
*Attorney, Agent, or Firm*—Walter Ottesen

[57] ABSTRACT

The invention is directed to an apparatus for cleaning the bottom and sides of a water-filled pool with an automatic pool cleaner equipped with motor-driven track belts (9*a,* 9*b*) and with a poolside programming module to control the cleaning method. The pool cleaner is equipped with two counter-rotating brush rollers (14*a,* 14*b*). Each brush roller is provided with a longitudinal shield (17*a,* 17*b*) which partly encloses the brush roller and is sealed against the pool cleaner chassis (1) to increase the water velocity generated by the pool cleaner pump impeller (4) thereby increasing the suction developed between the pool cleaner suction box (8) and the pool bottom or side walls, as applicable, to achieve more efficient cleaning and to ensure the travel of the pool cleaner, particularly along the side walls of the pool.

5 Claims, 3 Drawing Sheets

APPARATUS FOR CLEANING A WATER-FILLED POOL

FIELD OF THE INVENTION

The invention relates to an apparatus for cleaning the bottom and sides of a water-filled pool and an automatic pool cleaner. The automatic pool cleaner apparatus traverses the bottom and sides of the pool in a predetermined pattern and has counter-rotating brushes to clean the surfaces. A pump and a filter clean the water of dirt and return the clean water to the pool.

BACKGROUND OF THE INVENTION

Earlier devices, such as disclosed in International patent publication WO 94/23159, employ counter-rotating brushes. However, they can be used only to clean the sides of a pool at water level. Consequently, the pool must be drained to clean the complete side walls thereof. Furthermore, means to filter the dirty water are not available.

Another device is disclosed in German patent publication 1,920,172 and can be used only to clean the bottom of a pool. Although this device is equipped with a pump and a filter for cleaning the dirty water, it is not equipped with cleaning brushes of any kind.

Still another device is disclosed in U.S. Pat. No. 2,988,762 and is intended only for cleaning the bottom of a pool. This device is equipped with a pump and filter as well as fixed brushes which act on the already suction-cleaned surface and is, furthermore, provided at each end with adjustable bumpers which, on contact with the side of the pool, turns the device to the extent that it moves in a zigzag pattern over the bottom of the pool when returning in the opposite direction.

SUMMARY OF THE INVENTION

The object of the invention is to eliminate the disadvantages of earlier known apparatus by providing an apparatus for automatically cleaning both the bottom wall surface and side wall surfaces of water-filled pools.

The above object is achieved with the apparatus of the invention for cleaning the bottom wall surface and the side wall surfaces of the water-filled pool. The apparatus of the invention includes: a chassis; propulsion means mounted on the chassis for propelling the chassis in the forward and rearward directions over the wall surfaces; the chassis having a forward end transverse to the forward direction and a rearward end transverse to the rearward direction; first and second brush roller units mounted on the chassis at the forward and rearward ends, respectively; each of the brush roller units including: a brush roller; and, a pivot-arm assembly for pivotally connecting the brush roller to the chassis; motor means for imparting rotation to the brush rollers so that the brush rollers counterrotate relative to each other whereby dirt particles on the surfaces are thrown toward the region beneath the chassis; a filter; and, a pump system communicating with the filter and being mounted on the chassis for generating a partial vacuum beneath the chassis whereby the dirt particles become entrained and are conducted from beneath the chassis to the filter where the dirt particles are trapped and clean water is returned to the pool.

The chassis of the pool cleaner is provided with right-hand and left-hand track belts for propelling the pool cleaner with each track belt being driven by an individual reversible motor. Also, rotating brushes are provided and each rotating brush is driven by an individual motor. The brushes or brush rollers rotate at right angles to the track belts which are at the respective short ends of the chassis. The directions of rotation of the brush rollers are such that dirt is brushed inwardly towards the suction box located at the center of the chassis. Thus, and according to a feature of the invention, the brush motors impart rotation to the brush rollers so that the brush rollers counterrotate relative to each other whereby dirt particles on the wall surfaces of the pool are thrown toward the region beneath the chassis.

An electrically driven pump is mounted on the chassis and returns the water to the pool through a filter. According to another feature of the invention, the brush rollers are each provided with a longitudinal shield which is sealed against the chassis by a skirt made of a flexible material. This feature ensures that the suction exerted by the pump on the pool bottom wall surface is also sufficient to enable the cleaner to traverse the vertical side wall surfaces of the pool and to increase the pressure exerted by the brush rollers on these surfaces.

The automatic forward travel of the pool cleaner is such that the two track belts are driven at the same speed by their respective motors until one of the rotating brush rollers encounters a wall or some other obstacle in the pool. This increases the current in the particular brush roller drive motor which, following a certain delay, stops the track belt drive motors. The drive motors then restart in the reverse direction, with a variable delay between the left-hand and right-hand motors, to ensure that travel toward the opposite wall takes place in a desired pattern. The pattern can be varied with the aid of the control unit, for example, a zigzag movement can be selected or a parallel movement overlapping somewhat with the previous traversal can be selected.

Alternatively, the automatic forward travel can be adjusted so that the pool cleaner travels forward for a specified, variable time, at the end of which the track belts are stopped and restarted in the reverse direction with a variable delay between the left-hand and right-hand motors, so that the return travel to the next time-specific stop takes place in the desired pattern.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
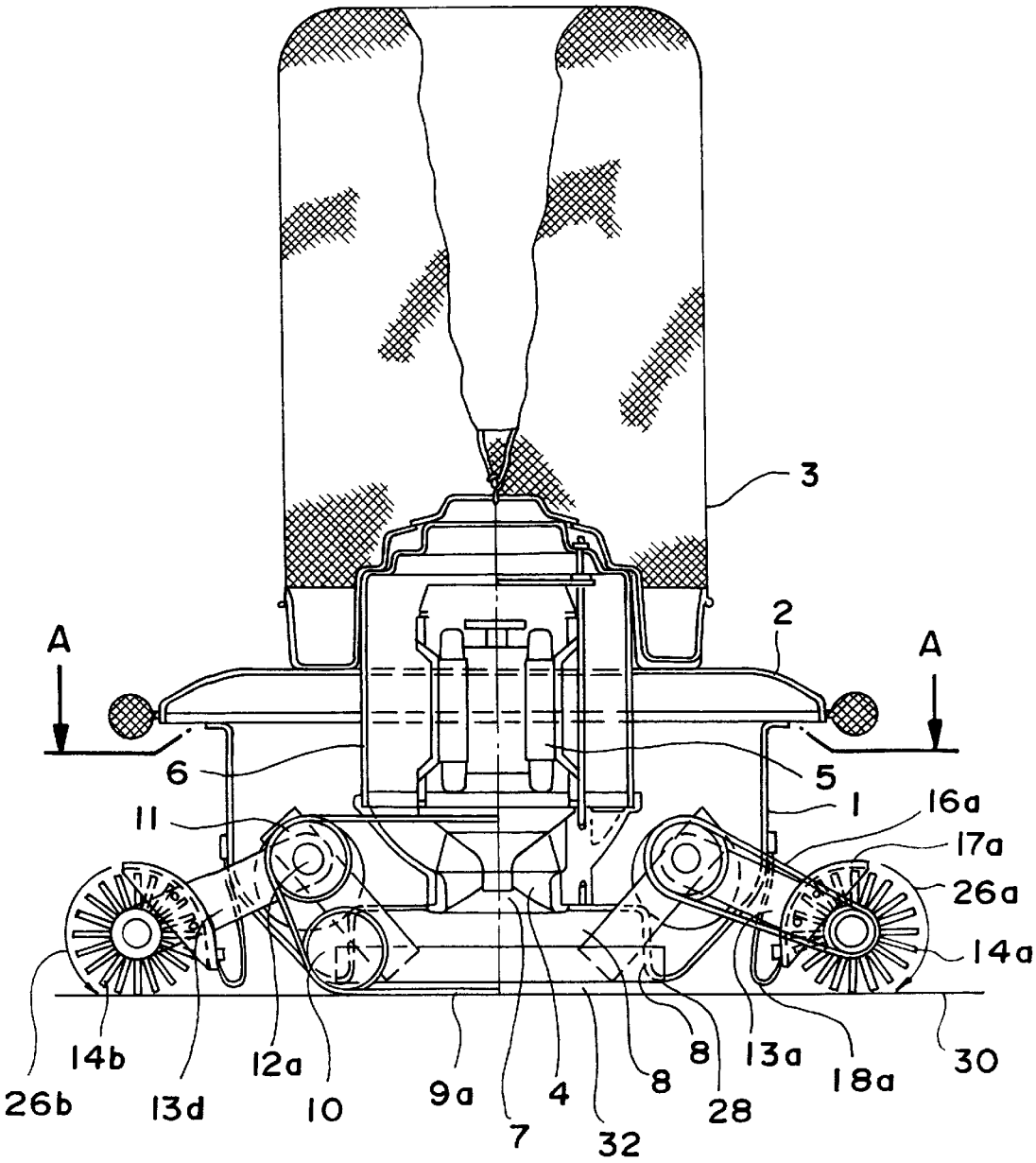
FIG. 1 is a side elevation view of the pool cleaner according to the invention.

FIG. 1 shows the pool cleaner chassis 1 and a cover 2 on which a filter bag 3 is mounted. A pump assembly includes a pump impeller 4 and a pump motor 5 for driving the impeller 4. The pump motor and impeller are housed in a cylindrical casing 6. The inlet opening 7 of the pump assembly is connected to a suction box 8 having lower edges 28 located immediately above the bottom wall surface 30 of the pool. The lower edges 28 and the bottom wall surface 30 conjointly define a gap 32 which permits the pool cleaner to pass over dirt particles so that they can be removed.

The pool cleaner is driven by two track belts (9*a*, 9*b*) of the toothed type tensioned around the idlers 10 and drive pulleys 11, the latter being attached to the output shafts (12*a,* 12*b*) of the respective drive motors (19*a,* 19*b*).

FIG. 1 also shows the brush rollers (14*a,* 14*b*) which are mounted on arms (13*a,* 13*b;* 13*c,* 13*d*) pivotally connected to the chassis 1. The brush rollers (14*a,* 14*b*) are driven via belts (16*a,* 16*b*) by the respective brush motors (21*a,* 21*b*) to rotate in mutually opposite directions as indicated by arrows 26*a* and 26*b*. To increase the water velocity and, as a result, the suction capacity at the brush rollers, the latter are provided with respective longitudinally extending shields (17*a,* 17*b*) extending along mutually opposite sides of the chassis 1 and attached to the pivotally mounted arms (13*a,* 13*b;* 13*c,* 13*d*). Each shield is sealed against the pool cleaner chassis 1 by a skirt 18 made of an elastic material and extending along the length of the shield. By increasing the suction developed between the pool cleaner suction box 8 and the pool wall bottom surface 30 or the side wall surfaces, a more efficient cleaning is achieved and the travel of the pool cleaner, particularly along the side walls of the pool, is ensured.

Figure 2:
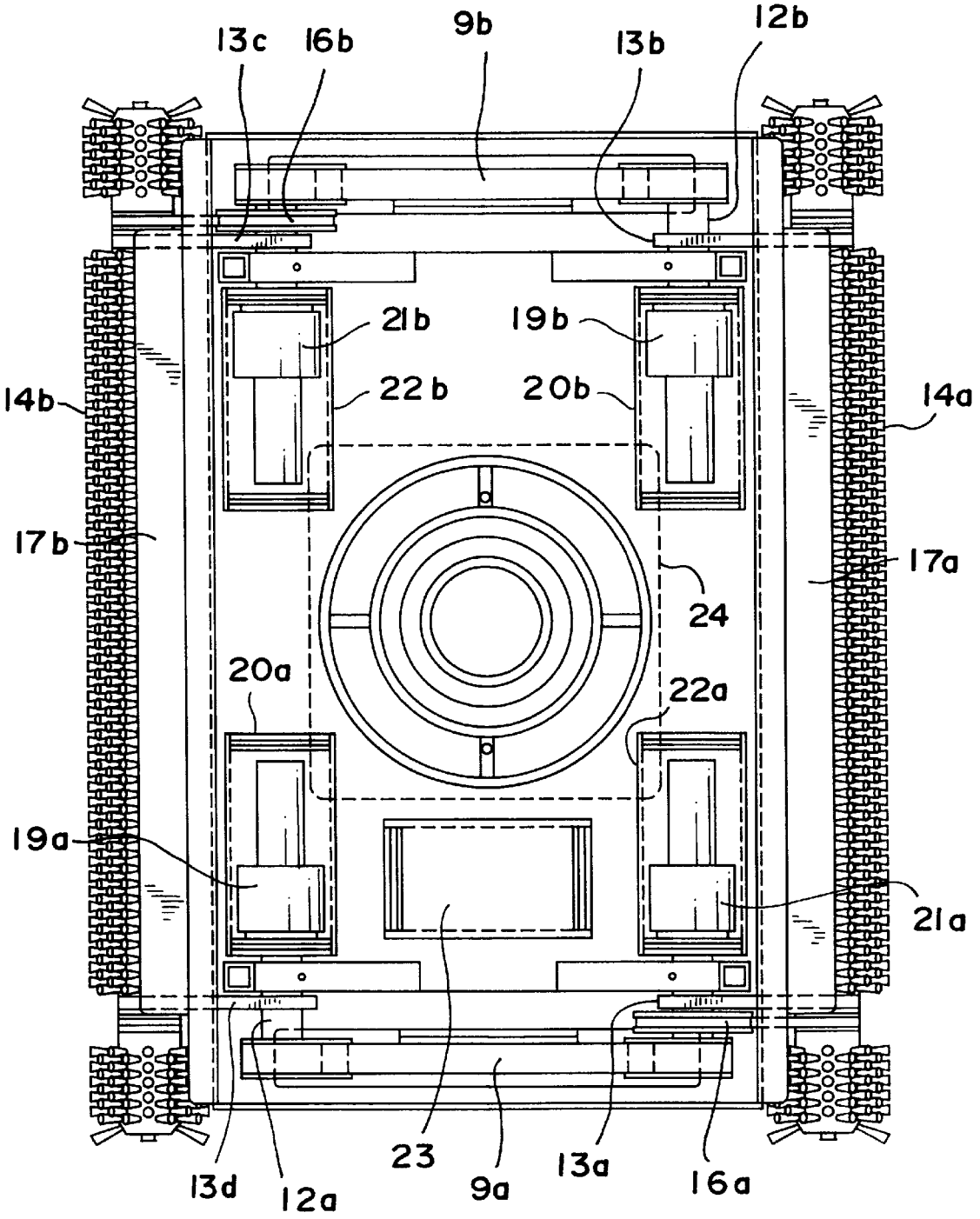
FIG. 2 is a plan view of the pool cleaner taken along line A—A of FIG. 1; and, FIG. 3 is a schematic showing a wiring diagram of the pool cleaner apparatus which includes the pool cleaner of FIGS. 1 and 2.

Referring to FIG. 2, the drive motors (19*a,* 19*b*) of the respective track belts (9*a,* 9*b*) are each housed in a water-tight casing (20*a,* 20*b*). Similarly, the brush motors (21*a,* 21*b*) of respective brush rollers (14*a,* 14*b*) are each housed in a water-tight casing (22*a,* 22*b*). The opening of the suction box 8 at the bottom of the pool is indicated by the dashed line 24. A water-tight automatic control unit 23 is mounted on the chassis 1.

The control unit 23 is connected by wiring accommodated in a floating hose, which also houses the motor supply cables, to a programming module (not shown in FIG. 2) at the side of the pool. The programming module 42 is shown in FIG. 3 and enables the operator to select the desired program for the pool cleaner, which then executes the program without further commands from the operator.

Figure 3:
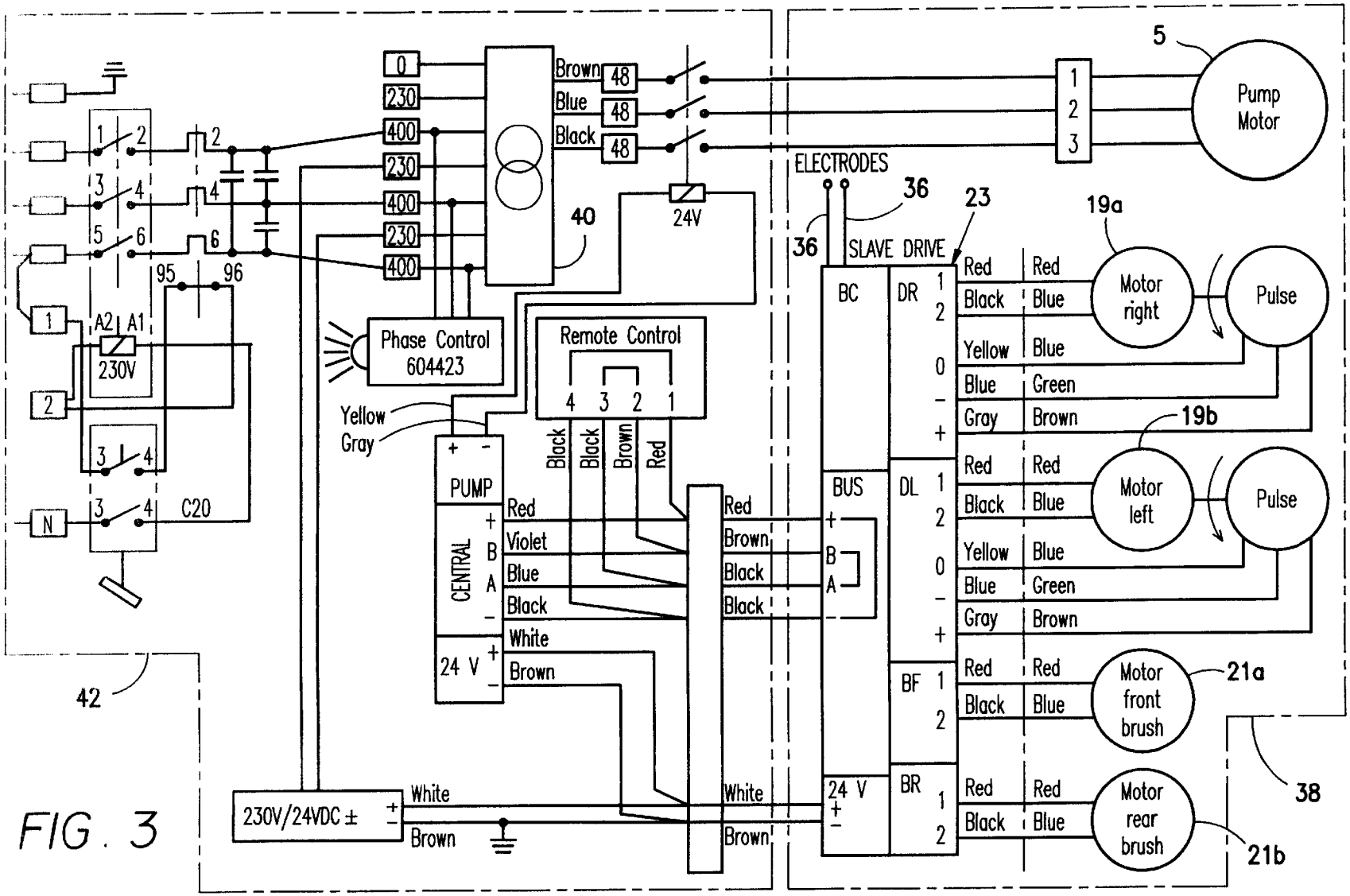

FIG. 3 shows the wiring diagram for the pool cleaner shown in FIGS. 1 and 2 and is subdivided into two major blocks 38 and 42. Block 38 shows the electrical elements of the apparatus which are mounted on the chassis 1 and are therefore under water. On the other hand, block 42 identifies the program module located above water at poolside. A hose capable of floating extends between blocks 38 and 48 and carries the control and motor supply cables interconnecting the two blocks.

Referring now to block 38, the automatic control unit 23 includes an electronic card accommodating the sensor for detecting changes in the current of the brush motors (21*a,* 21*b*) which occur when brush rollers (14*a,* 14*b*) encounter an obstacle. Reference numeral 36 identifies electrodes which coact with a sensor mounted in the automatic control unit 23 for detecting when the pool cleaner 1 reaches the surface of the water in the pool. The sensor of electrodes 36 senses this condition and causes the pump motor 5 to stop and changes the direction of rotation of the drive motors (19*a,* 19*b*) and restarts the pump motor 5 when the pool cleaner again submerges.

The program module 42 includes a transformer 40 for stepping down the voltage supplied to block 38 to protect users of the pool from electric shock injury.

It is understood that the foregoing description is that of the preferred embodiments of the invention and that various changes and modifications may be made thereto without departing from the spirit and scope of the invention as defined in the appended claims.

What is claimed is:

1. An apparatus for cleaning the bottom wall surface and the side wall surfaces of a water-filled pool, the apparatus comprising:

a chassis;

propulsion means mounted on said chassis for propelling said chassis in the forward and rearward directions over said wall surfaces;

said chassis having a forward end transverse to said forward direction and a rearward end transverse to said rearward direction;

first and second brush roller units mounted on said chassis at said forward and rearward ends, respectively;

each of said brush roller units including: a brush roller; and, a pivot-arm assembly for pivotally connecting said brush roller to said chassis;

motor means for imparting rotation to said brush rollers so that said brush rollers counterrotate relative to each other whereby dirt particles on said surfaces are thrown toward the region beneath said chassis;

a filter; and, a pump system communicating with said filter and being mounted on said chassis for generating a partial vacuum beneath said chassis whereby said dirt particles become entrained and are conducted from beneath said chassis to said filter where said dirt particles are trapped and clean water is returned to the pool.

2. The apparatus of claim 1, each of said brush roller units further comprising a shield mounted on said pivot-arm assembly so as to extend in the direction of the length of said brush roller and over about a quarter of the peripheral region of said brush roller.

3. The apparatus of claim 2, said pivot-arm assembly including two arms for rotatably holding said brush roller; said arms being pivotally mounted on said chassis so that said brush roller defines the outermost element of said apparatus at said forward or rearward end viewed in the direction of travel; and, said shield being mounted on said arms; and, said apparatus further comprising two skirts connected between respective ones of said shields and said chassis; and, each of said skirts extending along the length of the shield corresponding thereto and being made of elastic material whereby the skirt moves flexibly with said shield when said arms pivot as the brush roller encounters an obstacle or changes in the contour of said wall surfaces.

4. The apparatus of claim 3, said propulsion means comprising two track belts mounted on said chassis and two drive motors for driving said track belts, respectively; said motor means comprising two brush motors for corresponding ones of said brush rollers; and, two drive belts for connecting respective ones of said brush motors to corresponding ones of said brush rollers; and, an automatic control unit mounted on said chassis for detecting changes in the current in said brush motors which occurs when the brush roller driven by the brush motor encounters an obstacle; and, said automatic control unit being connected to said drive motors for reversing said drive motors in response to said current change whereby the pool cleaner moves away from the obstacle.

5. The apparatus of claim 4, further comprising a programming module connected to said automatic control unit to permit an operator to select a desired pool cleaner program which is then executed by said automatic control unit.

* * * * *